United States Patent [19]

Deschamps et al.

[11] Patent Number: 4,759,690

[45] Date of Patent: Jul. 26, 1988

[54] IMPELLER

[76] Inventors: John A. Deschamps, 16 Pickwood Road, Irene, Transvaal; Hendrik M. J. Horn, 4 Stinkhout Avenue, Eldoraigne, Verwoerdburg, Transvaal, both of South Africa

[21] Appl. No.: 893,792

[22] Filed: Aug. 6, 1986

Related U.S. Application Data

[63] Continuation-in-part of Ser. No. 736,846, May 22, 1985, abandoned.

[30] Foreign Application Priority Data

May 24, 1984 [ZA] South Africa ..... 84/3924

[51] Int. Cl.[4] ..... F04D 29/02

[52] U.S. Cl. ..... 416/186 R; 416/213 A; 416/229 R; 416/241 B

[58] Field of Search ..... 416/182, 187, 186 R, 416/241 B, 229 R, 229 A, 224, 213 A, 135 R; 415/214–215

[56] References Cited

U.S. PATENT DOCUMENTS

| | | | |
|---|---|---|---|
| 2,120,277 | 6/1938 | Grierson | 416/229 X |
| 2,262,039 | 11/1941 | Pekor | 416/186 R |
| 2,463,581 | 3/1949 | Welsh | 416/186 R |
| 2,625,884 | 1/1953 | Welsh | 416/186 R |
| 2,801,792 | 8/1957 | Lindhagen et al. | 416/229 A X |
| 2,811,339 | 10/1957 | Osborne et al. | 416/241 B X |
| 3,619,077 | 11/1971 | Wile et al. | 416/241 B X |
| 3,676,014 | 7/1972 | Bevan et al. | 416/241 B X |
| 3,784,320 | 1/1974 | Rossmann et al. | 416/241 B X |
| 4,314,794 | 2/1982 | Holden | 416/241 B X |
| 4,575,047 | 3/1986 | Boos et al. | 416/241 B X |
| 4,671,740 | 6/1987 | Ormiston et al. | 416/241 B |

FOREIGN PATENT DOCUMENTS

| | | | |
|---|---|---|---|
| 720956 | 12/1954 | United Kingdom | 416/187 |

*Primary Examiner*—Everette A. Powell, Jr.
*Attorney, Agent, or Firm*—Ladas & Parry

[57] ABSTRACT

A vane-type impeller having a plurality of abuttably-adjacent, interconnected components at least some of which are made of an abrasion-resistant ceramic material is improved by a layer of a resiliently-flexible material between at least each component made of an abrasion-resistant ceramic material and each component it is abuttably adjacent for increasing the capability of each component made of the abrasion-resistant material of withstanding impact forces.

17 Claims, 2 Drawing Sheets

IMPELLER

This is a continuation-in-part of copending application Ser. No. 736,846 filed on May 22, 1985, now abandoned.

This invention relates to an impeller for a rotary pump, particularly a centrifugal pump, intended to pump a fluid which includes solid particles capable of causing damage to the impeller as a result of the impact and sliding abrasion forces exerted by such particles on the operative surfaces of the impeller.

It is known to provide impellers or rotors for rotary pumps, engines, or the like, of which at least the operative surfaces of those parts which are most likely to come into contact with the fluid passing through the pump or engine are of an abrasion resistant material such as a suitable ceramic material, for example.

Thus, for example, U.S. Pat. No. 3,149,574 and UK Pat. No. 2,061,399 each discloses a centrifugal pump with a ceramic impeller.

Although such a ceramic material, because of its highly abrasion resistance, is very suited for pump impellers and the like, a serious disadvantage attached to such ceramic material relates to the fact that it is relatively brittle and hence vulnerable to heavy impact forces such as those which may be caused by solid particles present in a fluid such as a slurry or the like, which has to be moved by such an impeller. Apart from the fact that such forces can cause cracks in the surface of the impeller material, these cracks, because of the nature of the ceramic material, tend to spread throughout the ceramic body thereby causing a major breakdown of the apparatus.

It is accordingly an object of this invention to provide an impeller for a rotary pump, particularly a centrifugal pump, with which the applicant believes the aforesaid problems may be overcome or at least minimised.

According to the invention a vane-type impeller for a rotary pump includes a plurality of interconnected components of an abrasion resistant ceramic material, adjacent components being separated from one another and from any other solid body by a layer of resiliently flexible material so that no two components are in direct contact with each other or with any such solid body.

With this arrangement any impact force acting on a component is cushioned by at least the layer of resiliently flexible material in direct contact with that component, and, as a result of this, the component is capable of withstanding much higher impact forces that what would generally be the case with such a ceramic body on its own.

In neither of the aforesaid two patents, i.e. U.S. Pat. No. 3,149,574 or UK Pat. No. 2,061,399, is there any disclosure or suggestion that the ceramic material which is utilised should be so cushioned.

Although it has been known from before to employ an elastomeric material together with a ceramic material in such pumps and motors, it has never before been disclosed or suggested to do so for the purpose of improving the impact resistance of the ceramic material, and the known arrangements were accordingly also not designed with this in mind.

Thus, for example, in U.S. Pat. No. 4,314,794, a rotor blade for a gas turbine engine is disclosed comprising a plurality of interconnected superimposed ceramic washers supported on a ceramic platform, a layer of resilient complient interface material being provided between the platform and an underlying metal root segment. Part of the resilient layer also extends into the bore of an aperture which passes through the platform and into which the lower end of a metal tie tube is located which serves to interconnect the washers and platform. Although it is not clearly stated in this patent what the purpose of the aforesaid layer is, it is stated that it assists in the sealing of the tube in the aperture. It ostensibly also provides the blade and platform with an amount of resilient flexibility relative to the root segment. There is however, no suggestion in this patent that the purpose of the aforesaid layer is to absorb any impact forces encountered by the blade or the platform which are of a type similar to those which could be caused by solid particles present in the fluid passing through the engine. This is not surprising, since it is highly unlikely that forces of this type will be encountered in such a gas turbine engine. It is furthermore significant to note that in this patent none of the resilient complient material is provided between adjacent ceramic washers or between the bottom washer and the ceramic platform and that these components are accordingly in direct contact with each other. Any impact force which could accordingly be encountered by such a washer will be translated to adjacent washers substantially without any "cushioning" taking place. An impact force large enough to cause damage to one washer, can hence be translated to the next washer where it can cause the same damage to that washer, and so on to the last washer, and possibly also to the platform.

Further according to the invention at least some of the ceramic components are made up of smaller units which are also separated from each other by a layer of resiliently flexible material.

Apart from improving the cushioning effect of a component, this arrangement also serves to arrest any crack or the like which may form in a particular unit in the sense that it prevents such a crack from spreading to the next unit.

Preferably at least each vane of the impeller comprises a plurality of interconnected ceramic units separated from each other by a layer of resiliently flexible material.

Further according to the invention the impeller includes an impingement surface onto which fluid entering the impeller is intended to fall, the surface being defined by a plurality of interconnected ceramic units which are separated from each other by a layer of resiliently flexible material.

Each of the aforesaid components or units are preferably of a short stub-like configuration so that they have a geometric configuration approaching that of a cube.

Applicant has found that a ceramic component or unit of such configuration has a higher impact resistance than that of components or units of different configuration.

The layer of resiliently flexible material may be of any suitable thickness, but preferably it is in the order of 1–2 mm.

Still further according to the invention the operative faces of those components and/or units most likely to be subjected to impact forces when the impeller is in operation are of curved substantially convex configuration and substantially without any sharp edges.

With such an arrangement every point of such a surface is under the influence of compression forces which improves the ability of such a component or unit to withstand impact forces.

Thus, for example, the aforesaid impingement surface preferably includes a substantially centrally located ceramic body which is of substantially dome-shaped configuration in side view, and which is surrounded by a plurality of short stub-like segments.

Still further according to the invention the vanes of the impeller are carried between two side plates of an abrasive resistant ceramic material, a layer of resiliently flexible material being provided between each end vane and the adjacent side plate.

It will be appreciated that with this arrangement the radially extending pathway which is defined between adjacent vanes and the side plates of the impeller is of a material which is both abrasion and impact resistant and the useful life of such an impeller is accordingly substantially increased.

Still further according to the invention each vane of the impeller comprises a plurality of abrasion resistant ceramic elements located in overlying superimposed relationship to one another, adjacent elements being separated by a layer of the resiliently flexible material.

The vane elements are preferably of curved, preferably crescent, shape configuration in plan view, and preferably they are provided in a plurality of sets, each set constituting one vane.

It will be appreciated that the curved configuration of the vane elements serves to reduce the effect which impact forces may have on the elements' outer surfaces.

The vanes are preferably held in position between the side plates by means of transversely extending pins which slidably engage aligned apertures in the vanes and the side plates.

Further according to the invention each side plate is mounted in parallel spaced apart relationship to a concentrically located end plate, each side plate and end plate being separated by a layer of resiliently flexible material.

Preferably the said locating pins for the vanes have both their ends releasably secured to the end plates.

Preferably, also, one of the end plates is adapted for securement to the drive shaft responsible for rotating the impeller.

Further according to the invention the impeller includes an axially extending fluid inlet which is provided in one of the side plates, the opposite side plate constituting the impingement surface referred to above.

Still further according to the invention, the ceramic material comprises alumina (a type of aluminium oxide), and the resiliently flexible material comprises a suitable polyurethane which is secured to the relevant surfaces by means of a suitable fixative material or adhesive.

Preferably, the said inlet in the impeller includes an annular skirt located in the bore of the inlet which is intended sealingly to engage the bore of a fluid inlet provided in the casing of a pump on which the impeller is utilised.

Applicant has found that the useful life of an impeller according to the invention, i.e. wherein the vanes and side plates are made of alumina supported on polyurethane, is, on an average, substantially better than the best impeller presently available on the market.

Further according to the invention, a pump is provided which includes an impeller according to the invention carried for rotation in the pump's casing, at least part of the internal wall of the pump's casing being lined with an abrasive resistant material such as alumina, for example.

One embodiment of the invention will now be described by way of example with reference to the enclosed drawings wherein.

Figure 1:
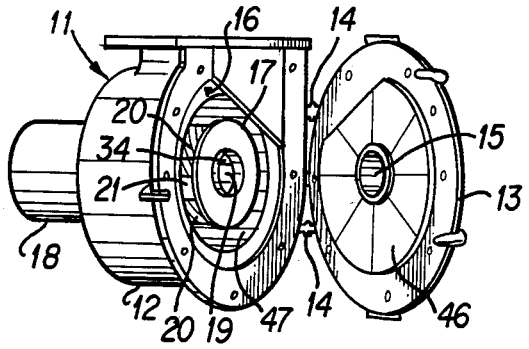
FIG. 1 is a diagrammatic perspective view of a centrifugal pump and impeller according to the invention.

In this embodiment of the invention a centrifugal pump 11 (FIG. 1) of conventional construction includes a hollow cylindrical casing 12 of which the one open end can be closed off by means of a lid 13 which is hingedly connected to casing 12 at 14 and which can releasably be secured thereto in any suitable manner.

Lid 13 includes a centrally located aperture 15, which serves as the suction inlet for pump 11, and which can be connected to a fluid source (not shown). Casing 12 includes a peripherally located aperture 16 which serves as the pump's outlet.

An impeller 17 (shown in more detail in FIGS. 2 to 4) is mounted for rotation in the bore of casing 12, the inner end of impeller 17 being connected to a drive shaft (not shown) which is carried in a shaft casing 18 and which extends through an aperture (not shown) provided in the rear end wall of casing 12.

Impeller 17 includes an axially extending centrally located inlet aperture 19 which is intended to communicate sealingly with aperture 15 in lid 13 on rotation of impeller 17.

Impeller 17 also includes four sets of circumferentially spaced substantially radially extending vanes 20 which define between them four radially extending outwardly flaring fluid paths 21 (FIG. 3) which, on rotation of impeller 17, can in turn communicate with outlet opening 16 in casing 12 and hence, in conventional manner, centrifugally fling fluid passing axially via inlet 19 into impeller 17, radially outwardly towards outlet 16. As can clearly be seen in FIGS. 3 and 5, each of vanes 20 is of substantially crescent shaped configuration in plan view.

Impeller 17 comprises a modular unit constituted by a plurality of interconnected components. These components comprises a disc like metal plate 22 of which the one side is secured to the end of the drive shaft (not shown) which is rotatably carried in casing 18.

Plate 22 is provided with eight spaced apart apertures 23 which are arranged in four pairs and which extend through plate 22 in predetermined positions relative to one another. Eight elongated metal pins 24 are adapted to be received in apertures 23. The ends of pins 24 are threaded so that they can each rotatably receive a conically shaped locking nut 25. The bores of apertures 23 are so shaped that nuts 25 can be received therein in countersunk fashion.

A disc like annular element 26, which is of alumina, has eight holes extending through it of which the diameters are similar in size to those of apertures 23 in plate 22. These holes are furthermore so positioned that when they are made to register with apertures 23 in plate 22, disc 26 is located concentrically relative to plate 22. As can be clearly seen from FIGS. 2 and 3, element 26 is constituted by a plurality of abutting individual units or segments 26.1.

A flat bottomed dome shaped body 27 of alumina is located in the bore of disc 26 exactly in the centre of plate 22, its dome shaped top projecting a substantial distance above the upper face of disc 26.

Two concentrically disposed alumina rings 28 and 29, which are also located on plate 22, serve to trap body 27 in the bore of disc 26. As can clearly be seen from FIGS. 2 and 3, each of rings 28 and 29 is also constituted by a plurality of abutting individual units or segments.

Figure 2:
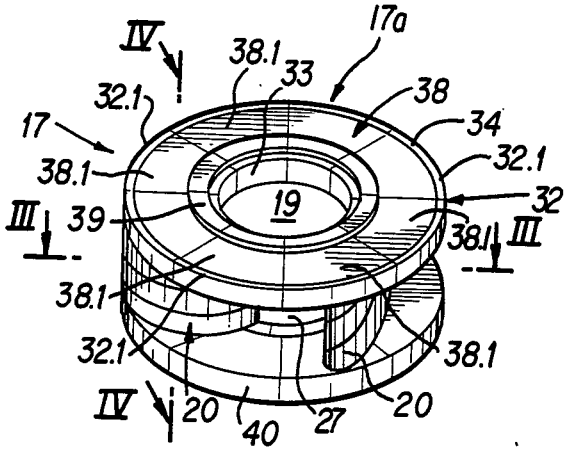
FIG. 2 is a diagrammatic perspective view showing the impeller of FIG. 1 in more detail.
Figure 5:
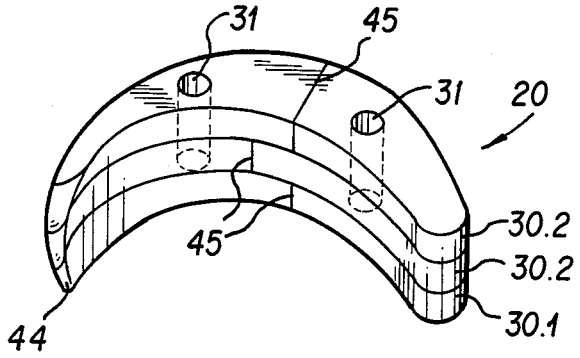
FIG. 5 is a diagrammatic perspective view of one of the vanes of the impeller of FIGS. 1 to 4.

As can be seen from FIGS. 2 and 5, each of the four sets of vanes 20 comprises three overlying superimposed crescent shaped elements 30.1, 30.2 and 30.3 which is of alumina and which is each provided with two spaced apart apertures 31 which, when brought into register with the apertures in the other vanes of a set, and with a pair of apertures 23 in plate 22 and disc 26, locate the particular vane 20 in the required position in impeller 17.

A disc like annular element 32, which is also of alumina, also has eight holes extending through it which are so disposed that when they are brought into register with corresponding apertures 31 of vanes 20, disc 32 is located concentrically relative to plate 22 and disc 26. Disc 32, which, as can be seen from FIG. 2, is also constituted by a plurality of abutting units or segments 32.1, has two concentrically spaced axially projecting annular skirt formations 33 and 34 (FIG. 4) which extend upwardly along its inner and outer peripheries respectively so that an annular recess 35 is defined between them. As can be seen from FIG. 4, skirt 33 is slightly longer than skirt 34.

An annular metal plate 36, which is located in recess 35, has eight apertures 37 extending throughout it which are so disposed that when they are brought into register with corresponding apertures in disc 32, plate 36 is located concentrically relative to disc 26 and plate 22. Apertures 37 in plate 36 are similarly shaped to apertures 23 in plate 22 so that nuts 25 can also be received therein in countersunk fashion.

Figure 4:
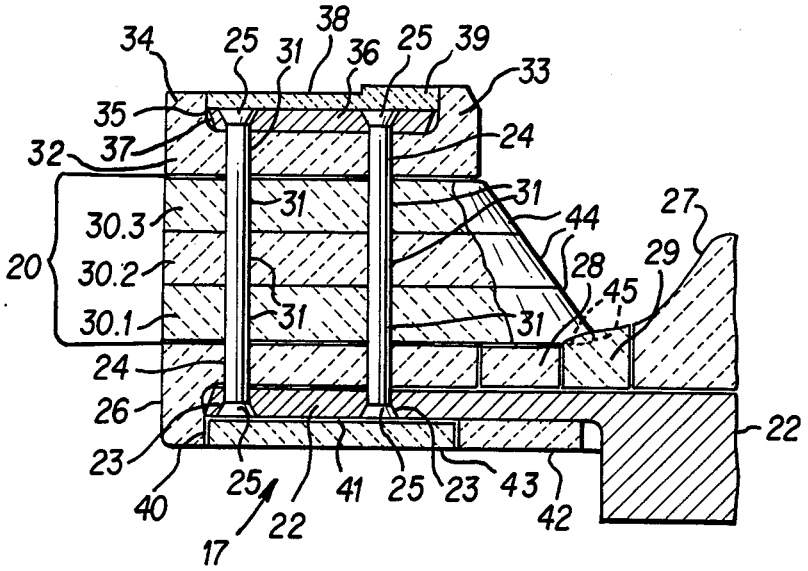
FIG. 4 is an enlarged modified cross section on line IV:IV in FIG. 2, the modification comprising the fact that the vane of the impeller is shown in profile as seen from a different angle.

As can be seen from FIG. 4, the thickness of plate 36 is less then the depth of recess 35 so that an annular groove is left on top of plate 3 in which an annular disc 38 of alumina can be located. As can be seen from FIG. 2, disc 38 is also constituted by a plurality of abutting units or segments 38.1, while it will be seen from FIGS. 2 and 4 that disc 38 includes towards its inner periphery an annular raised formation 39 of which the upper face is located substantially flush with the upper face of skirt 33.

The bore of disc 32 is adapted by means of an annular ceramic insert (not shown) to communicate slidably with inlet aperture 15 of lid 13 of pump 11 while impeller 17 is rotating.

Figure 3:
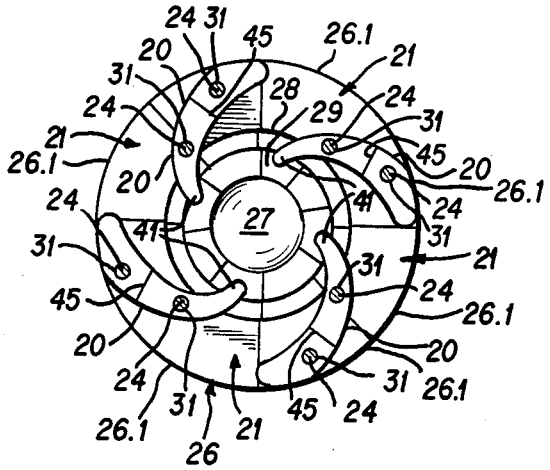
FIG. 3 is a cross section on line III:III in FIG. 2.

As can be seen from FIGS. 3 and 4, ceramic disc 26 also includes along its outer periphery downwardly projecting annular skirt formation 40 which extends for a distance beyond metal plate 22 so that an annular recess 41 is provided in which two concentrically disposed segmented ceramic rings 42 and 43 are located.

As can be seen from FIGS. 4 and 5, the vane elements 30 of each vane 20 are progressively shorter from the bottom element 30.1 to the top element 30.3 so that that part of the inlet aperture 19 collectively defined by them tapers inwardly from the top to the bottom.

As can clearly be seen from FIG. 5, the inner tips 44 of each of the vane elements 30 are smoothly rounded off so that they do not present any sharp edges in aperture 19. In order smoothly to accomodate the curved tip 44 of each of the bottom elements 30.1 of vanes 20, each tip 44 is adapted to nest in a recess 45 which is provided in the upper face of one of the segments making up ring 29.

As can also be seen from FIG. 5, each element 30 is made up of two units which abut at 45.

In order to assemble and secure the various components of impeller 17 in the required interrelationship, all those parts of the components and units intended to abut adjacently located components and units or any other solid body, are coated with a suitable adhesive and a layer of polyurethane, approximately 1–2 mm thick, applied thereto. Metal plate 22 is then located in a jig (not shown) and pins 24, to which a similar layer of adhesive and polyurethane is applied, located in apertures 23 so that they extend upwardly away from plate 22. They are then secured in this position by means of nuts 25. Disc 26 is then located on top of plate 22 by making the apertures in plate 26 to engage pins 24 slidably from above. Dome shaped ceramic body 27 is then loated on top of metal disc 22 in the centre thereof and segmented alumina rings 28 and 29 located in position in the bore of disc 26 on top of disc 22 and in abutting relationship to each other.

Vane elements 30, discs 32 and 38 and metal plate 36 are then each in turn located in position so that their corresponding apertures engage pins 24 slidably from above.

It will be appreciated that in the assembled form a layer of polyurethane approximately 1–2 mm thick is present between the abutting interfaces of all the components and units. The adhesively coated polyurethane, together with pins 24, accordingly serves to interconnect the components to one another.

When the polyurethane and adhesive have set, the assembly is turned up-side-down and segmented ceramic rings 42 and 43 located and secured in position in the same manner as described above to the rear face of plate 22.

The completely assembled impeller 17 is then located in casing 12, and the aforesaid ceramic insert (not shown) located in inlet aperture 19 so that when lid 13 is closed, inlet aperture 19 can sealingly engage aperture 15 in lid 13 during rotation of impeller 17 to effect a fluid tight seal between them.

Lid 15 is also provided on its inside face with an annular segmented disc like pad 46 of alumina, while the inside circumferentially extending side wall of casing 12 is lined with a plurality of tiles 47 which are also of alumina.

It will be appreciated that the various alumina components may be manufactured in any suitable manner such as, for example, by means of slip casting. The components preferably have a density in the order of 3.6 g/cc and an alumina ($Al_2O_3$) content of more than 94%.

It will further be appreciated that the invention also includes within its scope a method of manufacturing an impeller which includes the steps of providing the various components substantially as shown in the figure, and then assembling and securing them in the aforesaid interrelationship in the manner set out above.

In operation, when pump 11 is employed to pump an abrasive fluid such as a slurry or the like which may contain solid particulars which render it very abrasive and destructive, the fact that the body 27, which serves as the first impact surface; the walls of passage 21 which are defined between discs 26 and 32 and vanes 20; and vanes 20 themselves are all of abrasion resistant alumina, substantially minimises the abrasive action which the fluid may have on the pump and impeller components.

Furthermore, because the vane elements 30, discs 26 and 32 and substantial all the other components are mounted resiliently flexible relative to one another, and also because all the ceramic components are made up of smaller units which are of substantially short stub-like configuration, impeller 15 is capable of withstanding much greater impact forces than what would otherwise be the case. In the case of vane elements 30 and body 27, this is further enhanced by the curved configuration of their operative faces. Applicant has accordingly found that a pump and/or impeller made according to the invention has a much longer life than what the case generally is with any of the known arrangements.

We claim:

1. A vane-type impeller for a rotary pump comprising a plurality of interconnected components of which at least those defining the working surfaces of the impeller are of an abrasion resistant ceramic material, characterized in that all abutting components have a resiliently flexible layer of an elastomeric material disposed in the interface between them for absorbing mechanical stresses which may develop in a ceramic component as a result of an impact between such a component and an external body, and which could otherwise cause the ceramic material to break.

2. The impeller of claim 1 wherein at least some of the ceramic components are made up of smaller interconnected units which are also separated from each other by a layer of resiliently flexible material.

3. The impeller of claim 1 wherein each vane of the impeller comprises a plurality of interconnected abrasion resistant ceramic elements which are located in overlying superimposed relationship to one another, adjacent elements being separated from each other by a layer of resiliently flexible material.

4. The impeller of claim 3 wherein each element comprises at least two interconnected units which are separated from each other by a layer of resiliently flexible material.

5. The impeller of claim 4 wherein the elements are of short stub-like configuration and of substantially crescent shape in plan view.

6. The impeller of claim 2 wherein the operative faces of those components and units most likely to be subjected to impact forces when the impeller is in operation are of curved substantially convex configuration.

7. The impeller of claim 1 including an impingement surface onto which fluid entering the impeller is intended to fall, the surface being defined by a plurality of interconnected ceramic units which are separated from each other by a layer of resiliently flexible material.

8. The impeller of claim 7 wherein one of the units comprises a substantially centrally located ceramic body which is of substantially dome-shaped configuration in side view and the other units comprise a plurality of substantially stub-like ceramic segments located around the dome-shaped ceramic body.

9. The impeller of claim 1 wherein the vanes of the impeller are carried between two side plates of an abrasion resistant ceramic material, a layer of resiliently flexible material being provided between the end of each vane and the adjacent side plate, the vanes being held in position between the side plates by means of transversely extending pins which slidably engage aligned apertures in the vanes and the side plates.

10. The impeller of claim 9 wherein each side plate is mounted in parallel spaced apart relationship to a concentrically disposed metal end plate, each side plate and end plate being separated by a layer of resiliently flexible material; the end plates including apertures which can be aligned with the apertures in the side plates and vanes so that the ends of the said elongated pins passing though the apertures in the side plates and vanes can be received in them; and the said ends of the pins being adapted to be secured to the end plates; one of the end plates being adapted for securement to the drive shaft responsible for rotating the impeller.

11. The impeller of claim 9 including an axially extending fluid inlet which is provided in one of the side plates, the opposite side plate including an impingement surface onto which fluid passing into the impeller through the inlet is intended to fall.

12. The impeller of claim 2 wherein the thickness of the resiliently flexible material layer is in the order of 1–2 mm and wherein it is applied to the relevant surfaces by means of a suitable adhesive.

13. The impeller of claim 1 wherein the ceramic material comprises alumina and the resiliently flexible material comprises a suitable polyurethane.

14. In a vane-type impeller having a plurality of abuttably-adjacent, interconnected components at least some of which are made of an abrasion-resistant ceramic material, the improvement comprising:

a layer of a resiliently-flexible material between at least each component made of an abrasion-resistant ceramic material and each component it is abuttably adjacent for increasing the capability of each component made of the abrasion-resistant material of withstanding impact forces.

15. The vane-type impeller of claim 14, wherein the layer comprises polyurethane and an adhesive for also interconnecting the components abuttably adjacent thereat.

16. The vane-type impeller of claim 15, wherein the layer is from about 1 mm to about 2 mm thick between the components abuttably thereat.

17. In a method of making vane-type impeller having a plurality of abuttably-adjacent, interconnected components at least some of which are made of an abrasion-resistant ceramic material, the improvement comprising:

providing a layer of a resiliently-flexible material between at least each component made of an abrasion-resistant ceramic material and each component it is abuttably adjacent for increasing the capability of each component made of the abrasion-resistant material of withstanding impact forces.

* * * * *